US006910603B2

(12) United States Patent
Smith

(10) Patent No.: US 6,910,603 B2
(45) Date of Patent: Jun. 28, 2005

(54) LEAK PREVENTING CLOSURE IN A DISPENSER PUMP

(75) Inventor: Richard Smith, Stoney Stanton (GB)

(73) Assignee: Scope Next Limited, Coventry (GB)

( * ) Notice: Subject to any disclaimer, the term of this patent is extended or adjusted under 35 U.S.C. 154(b) by 0 days.

(21) Appl. No.: 10/494,009

(22) PCT Filed: Oct. 25, 2002

(86) PCT No.: PCT/GB02/04878

§ 371 (c)(1),
(2), (4) Date: Apr. 25, 2004

(87) PCT Pub. No.: WO03/035274

PCT Pub. Date: May 1, 2003

(65) Prior Publication Data

US 2004/0256413 A1 Dec. 23, 2004

(30) Foreign Application Priority Data

Oct. 26, 2001 (GB) ..... 0125702

(51) Int. Cl.[7] ..... B05B 11/00

(52) U.S. Cl. ..... 222/153.13; 222/207; 222/380; 222/383.1

(58) Field of Search ..... 222/153.13, 207, 222/380, 383.1

(56) References Cited

U.S. PATENT DOCUMENTS

| | | | | | |
|---|---|---|---|---|---|
| 2,690,278 | A | * | 9/1954 | Bacheller | 222/207 |
| 2,853,210 | A | * | 9/1958 | Cooprider et al. | 222/207 |
| 3,102,489 | A | * | 9/1963 | Cooprider et al. | 222/207 |
| 3,752,366 | A | * | 8/1973 | Lawrence, Jr. | 222/207 |
| 3,753,518 | A | * | 8/1973 | Kutik | 222/207 |
| 3,785,532 | A | * | 1/1974 | Cooprider | 222/207 |
| 4,300,705 | A | * | 11/1981 | Shy | 222/207 |
| 4,474,314 | A | | 10/1984 | Roggenburg | |
| 4,867,347 | A | * | 9/1989 | Wass et al. | 222/153.13 |
| 4,991,746 | A | | 2/1991 | Schultz | |
| 5,544,789 | A | * | 8/1996 | Gillingham | 222/153.13 |
| 5,829,640 | A | * | 11/1998 | Hershey et al. | 222/153.13 |
| 5,875,936 | A | * | 3/1999 | Turbett et al. | 222/207 |
| 6,672,485 | B2 | * | 1/2004 | Mascitelli | 222/207 |
| 2004/0256413 | A1 | * | 12/2004 | Smith | 222/207 |

FOREIGN PATENT DOCUMENTS

| | | | |
|---|---|---|---|
| EP | 0 274 877 | 7/1988 | |
| WO | WO 3035274 A1 * | 5/2003 | B05B/11/00 |

* cited by examiner

*Primary Examiner*—Kenneth Bomberg
(74) *Attorney, Agent, or Firm*—Clifford Kraft

(57) ABSTRACT

A dispenser pump has a fixed spout (15) on an upper component (10) which is rotatable relative to a lower component (11) adapted to be fitted to a container (not shown). For transport and storage the spout (15) is rotated so that its inner opening is obturated by the distal end of an arm (13) of the lower component which circumferentially divides its discharge compartment (31). Simultaneously an air opening (22) of the upper component is obturated by the arm (13) which also circumferentially divides an annular air chamber (32) below the discharge compartment (31). The compartment (31) and air chamber (32) are separated by an annular barrier seal (23) in rubbing contact with the internal wall of the upper component (10). By this provision the danger of leakage is so much reduced that it is not necessary to provide a mechanical lock for the pump when the dispenser is closed.

10 Claims, 1 Drawing Sheet

LEAK PREVENTING CLOSURE IN A DISPENSER PUMP

This invention relates to an improved dispenser pump of the kind which, when mounted on a container for a liquid or pasty substance such as soap, will dispense a measured quantity of the substance when the pump is manually actuated. Dispenser pumps of this kind are well known and are to be distinguished from valves for e.g. aerosol sprays which when opened dispense as a result of pressurisation of the container.

Fixed spout dispenser pumps have a lower component adapted to be fitted to a container and an upper component rotatable relative to the lower component to bring the spout on the upper component into or out of register with an outlet passage which is stationary with respect to the lower component. The pump itself may take the form of a piston-and-cylinder assembly or it may take the form of a self-restoring, deformable part of the upper component. When this is compressed the internal volume of the upper component is diminished. When it is released and allowed to expand the substance in the container is sucked into the upper component through a first one-way valve. When the deformable part of the upper component is depressed a second time the substance it contains is expelled through the spout through a second one-way valve. When allowed to expand again the upper component sucks a second, measured quantity of the substance into its interior ready to be dispensed.

The pump will of course only dispense if the spout is aligned with the outlet passage, enabling the pump to be "closed" e.g. during transport and storage. However to prevent leakage if the pump is accidentally depressed while "closed" it has been found necessary to incorporate a locking feature which mechanically prevents actuation of the pump when the outlet passage is not aligned with the spout.

The danger of leakage is increased by the fact that in addition to the outlet passage and spout it is necessary to provide a second path through the dispenser pump between ambient air and the interior of the container. Unless air can enter the container to replace the substance sucked out of it the pump will not work. Therefore an air passage has been provided through the lower component which registers with an air hole in the upper component only when the outlet passage is in register with the spout. EP-A-0 274 877 exemplifies such an arrangement in which the orifices of the outlet passage and air passage of the lower component have a circumferential separation around the cylindrical outer surface of the lower component which is equal to the circumferential separation of the spout and the air hole on the cylindrical inner surface of the upper component, the cylindrical surfaces sliding relative to one-another as the upper component is rotated and providing the closure of the outlet and air passages when the spout is taken out of alignment with the outlet passage. If the pump is subjected to sufficient pressure leakage may occur between the cylindrical surfaces. The substance in the container may migrate between these surfaces from the outlet passage to at least the nearer of the air hole and the spout and it is to prevent this that the mechanical locking feature has been provided.

The mechanical locking feature however adds to the complexity of the dispenser pump and is therefore to the cost of its manufacture. An object of the present invention is to obviate the need for the locking feature by providing a more efficient seal when the upper component is rotated to the closed position.

In accordance with the present invention there is provided a dispenser pump comprising a lower component adapted to be fitted to a container for a liquid or pasty substance to be dispensed and an upper component rotatable relative to the lower component and having a spout opening and an air opening, the lower component comprising a passageway for communicating the interior of the container, with the interior of the upper component, said passageway controlled by a first non-return valve, an annular discharge compartment of the lower component surrounding said passageway, a second non-return valve permitting discharge of the substance from the interior of the upper component into said discharge compartment while preventing the entry of air to the interior of the upper component from the spout opening and an obturating element integral with the lower component located at and circumferentially interrupting the periphery of said compartment, the arrangement being such that in one angular orientation of the upper relative to the lower component the spout opening and the air opening are obturated by the obturating element while in other angular orientations of the upper component the interior of the upper component can communicate with the spout opening through the discharge chamber and a pathway for air to enter the container provided through the lower component is in communication with said air opening.

Preferably said pathway for air includes an annular chamber surrounding said passageway below the discharge compartment and separated therefrom by an annular barrier seal in rubbing contact between the upper and lower components and the spout opening and the air opening are spaced in the direction of the axis of rotation of the upper relative to the lower component such that the spout opening will align with the discharge compartment and the air opening will align with the annular air chamber on opposite sides of said barrier seal.

The obturating element may comprise the distal end of an arm circumferentially interrupting the discharge compartment. The obturating element may also comprise the distal end of an arm circumferentially interrupting the air chamber.

The said arms may lie in the same plane which contains the axis of rotation and the spout opening the the air opening will also lie in the same plane containing the axis of rotation.

In a preferred embodiment of the invention the second non-return valve is in the form of a deflectable member which extends from and surrounds an upper region of said passageway of the lower component, the periphery of said deflectable member making contact with a shoulder of the interior of the upper component which prevents upward but allows downward deflection of the periphery of said deflectable member.

Preferably said deflectable member defines the upper end of the discharge compartment.

At least the said barrier seal may be of a softer material than the cylindrical component surface with which it is in rubbing contact. The lower component as a whole may be of a softer material than the upper component.

The upper component may comprise a top region of a self-restoring concertina configuration whereby the interior volume of the upper component is variable.

A preferred embodiment of the present invention will now be described with reference to the accompanying drawings, in which.

Figure 2:
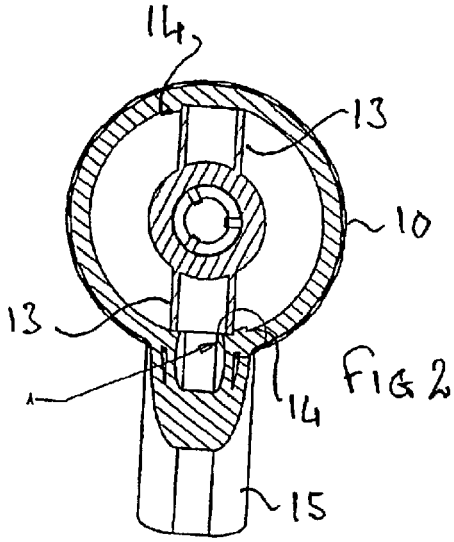
FIG. 2 is a sectional view taken on the line B—B of FIG. 1.
Figure 1:
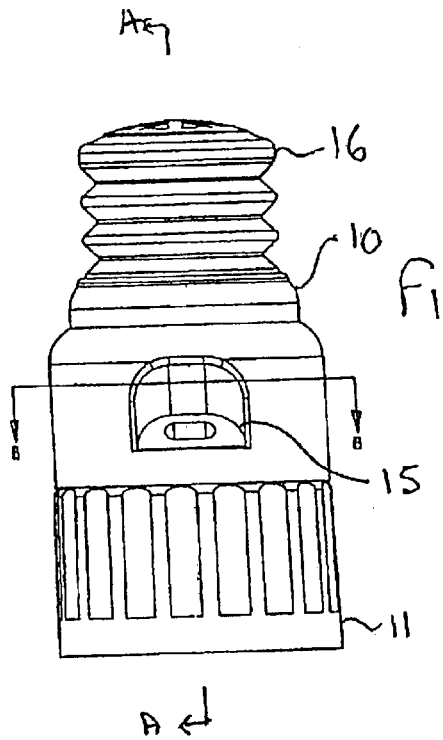
FIG. 1 is a front view of a dispenser pump in accordance with the invention.
Figure 4:
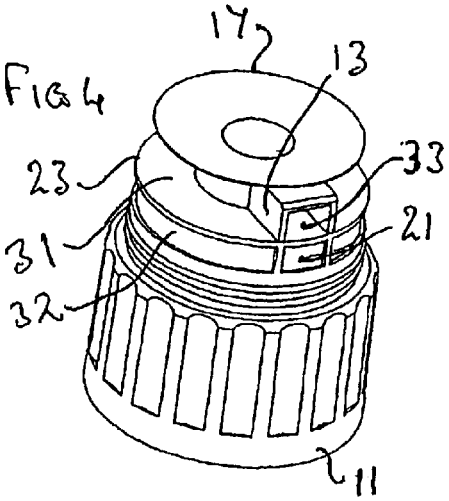
FIG. 4 is a perspective view of the lower component of the dispenser pump in isolation from the upper component.

The dispenser pump illustrated has an upper component 10 which is rotatable relative to a lower component 11. Twin annular beads 12 of the lower component snap engage in twin annular grooves on the inner surface of the upper component 10 to permit this rotation, which is limited to just less than 1800 by the abutment of radial arms 13 of the lower component with step formations 14 of the upper component. The upper component 10 has a fixed spout 15 and its top 16 is in the form of a self-restoring concertina bellows. Collapsing pressure on the bellows 16 will reduce the internal volume of the upper component 10 and self-restoration of the bellows 16 will increase it, thus providing the necessary pumping action.

The lower component 11 is formed at its lower end with an internal screw thread to engage a container (not shown) for the liquid or pasty substance to be dispensed. It has a central passageway 30 controlled by a non-return valve 19 for communicating the interior of the container with the interior of the upper component 10. In the example illustrated the valve 19 is a caged ball valve but this could be replaced by a flap valve. In use a tube (not shown) will extend from a downward extension 20 of the passageway 30 to a position near the bottom of the container to ensure that air will not be pumped out of the container at least until its contents are nearly exhausted.

An annular discharge compartment 31 of the lower component 11 surrounding its passageway 30 has an upper wall in the form of a second non-return valve 17 and a lower wall the periphery 23 of which makes rubbing contact with the internal surface of the upper component. The second non-return valve 17 is in the form of an annular member surrounding the top end of the passageway 30 which is upwardly dished and is thinned toward its periphery so as to be deflectable. The periphery of the disc 17 contacts a shoulder 18 of the interior of the upper component 10 so that it cannot deflect upwardly (to permit air to enter the interior of the upper component from the spout) but so that it can be, deflected downwardly to allow the substance being dispensed to enter the compartment 31 from the interior of the upper component 10.

To enable air to replace the content of the container as it is pumped out an air opening 22 is provided in the upper component 10 below the spout 15. The periphery of the lower component 11 has an annular air chamber 32 divided from the discharge compartment 31 by the periphery 23. At one or more circumferential positions an air hole (not shown) is provided in the radially inner wall of this air chamber 32 to communicate the air opening 22 with the interior of the container.

Figure 3:
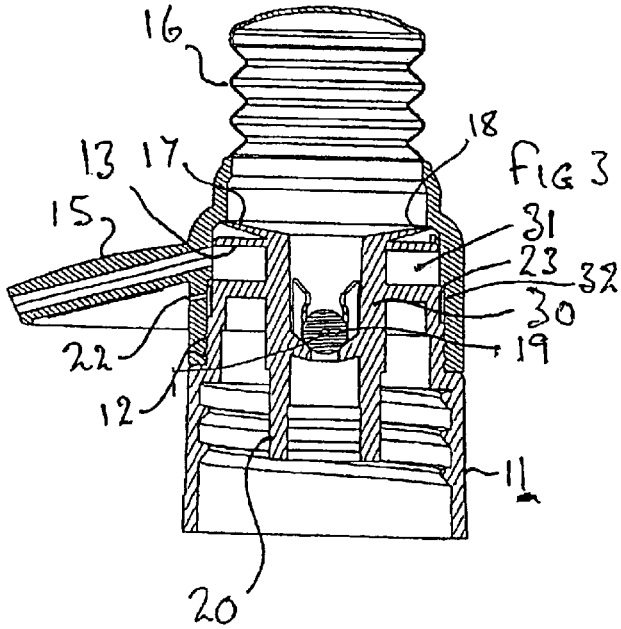
FIG. 3 is a sectional elevation of the dispenser pump taken on the line A—A of FIG. 1.

The radial arms 13 interrupt circumferentially both the annular discharge compartment 31 and the annular air chamber 32, their distal ends being in rubbing contact with the cylindrical inner wall of the upper component 10. The upper of the two arms 13 shown in FIG. 2 is provided only for mechanical balance and could be either omitted or perforated, but the distal end of the other arm serves as an obturating element which will close both the inner end opening of the spout 15 and the air opening 22 when the upper component 10 is rotated to the position in which it is shown in FIGS. 2 and 3. Resilient pads 21 and 33 may be secured to the distal end of the obturating arm 13 above and below the annular barrier seal provided by the periphery 23 to improve the closure.

It is preferable that the lower component 11 is moulded from a softer material than the upper component 10, in which case the pads 33 and 21 may be unnecessary.

To operate the pump the upper component 10 is rotated to a position in which the inner opening of the spout 15 and the air opening 22 are no longer obturated by the arm 13. The bellows 16 is compressed, expelling air through the spout 15. When pressure on the bellows 16 is relieved it restores its shape, thereby sucking into its interior the contents of the container through the valve 19. When the bellows 16 is compressed a second time the valve 19 closes and the content of the interior of the upper component 10 is expelled past the valve 17 into the discharge compartment 31 and thence out through the spout 15. This process can of course be repeated as often as necessary to dispense the desired quantity of the liquid or paste from the container.

The bellows 16 could be replaced by a simple bulb. The improved seals preventing leakage of the content of the upper component 10 in the closed position of the dispenser permits the use of a flexible pump of this kind in place of a more complex and expensive piston-and-cylinder assembly and obviates the need for a mechanical lock preventing actuation of the pump when the dispenser is "closed".

What is claimed is:

1. A dispenser pump comprising a lower component (11) adapted to be fitted to a container for a liquid or pasty substance to be dispensed and an upper component (10) rotatable relative to the lower component (11) and having a spout opening (15) and an air opening (22), the lower component (11) comprising a passageway (30) for communicating the interior of the container with the interior of the upper component (10), said passageway (30) controlled by a first non-return valve (19), characterised in that there is provided an annular discharge compartment (31) of the lower component (11) surrounding said passageway (30), a second non-return valve (17) permitting discharge of the substance from the interior of the upper component (10) into said discharge compartment (31) while preventing the entry of air to the interior of the upper component (10) from the spout opening (15) and an obturating element (13) integral with the lower component (11) located at and circumferentially interrupting the periphery of the compartment, the arrangement being such that in one angular orientation of the upper (10) relative to the lower component (11) the spout opening (15) and the air opening (22) are obturated by the obturating element (13) while in other angular orientations of the upper component (10) the interior of the upper component (10) can communicate with the spout opening (15) through the discharge compartment (31) and a pathway for air to enter the container provided through the lower component (11) is in communication with said air opening (22).

2. A dispenser pump as claimed in claim 1 characterised in that said pathway for air includes an annular chamber (32) surrounding said passageway below the discharge compartment (31) and separated therefrom by an annular barrier seal (23) in rubbing contact between the upper (10) and lower (11) components and wherein the spout opening (15) and the air opening (22) are spaced in the direction of the axis of rotation of the upper (10) relative to the lower (11) component such that the spout opening (15) will align with the discharge compartment (31) and the air opening (22) will align with the annular air chamber (32) on opposite sides of said barrier seal (23).

3. A dispenser pump as claimed in claim 2, characterised in that the obturating element (13) comprises the distal end of an arm (13) circumferentially interrupting the discharge compartment (31).

4. A dispenser pump as claimed in claim 3, characterised in that the obturating element (13) also comprises the distal end of an arm (13) circumferentially interrupting the air chamber (32).

5. A dispenser pump as claimed in claim 4, characterised in that the arms (13) lie in the same plane which contains the axis of rotation and the spout opening (15) and the air opening )22 line in the same plane containing the axis of rotation.

6. A dispenser pump as claimed in claim 1, characterised in that the second non-return valve (17) is in the form of a deflectable member which extends from and surrounds an upper region of said passageway of the lower component (11), the periphery of said deflectable member making contact with a shoulder (18) of the interior of the upper component (10) which prevents upward but allows downward deflection of the periphery of said deflectable member.

7. A dispenser pump as claimed in claim 6, characterised in that said deflectable member defines the upper end of the discharge compartment (31).

8. A dispenser pump as claimed in claim 2, characterised in that the said barrier seal (23) is of a softer material than the cylindrical component surface with which it is in rubbing contact.

9. A dispenser pump as claimed in claim 1, characterised in that the lower component (11) is of a softer material than the upper component (10).

10. A dispenser pump as claimed in claim 1, characterised in that the upper component (10) comprises a top region (16) of a self-restoring concertina configuration whereby the interior volume of the upper component (10) is variable.

* * * * *